US010927564B2

(12) United States Patent
Sanchez

(10) Patent No.: US 10,927,564 B2
(45) Date of Patent: Feb. 23, 2021

(54) CHAIN AND LEVER POST PULLER SYSTEMS

(71) Applicant: Margarito Sanchez, Pasadena, TX (US)

(72) Inventor: Margarito Sanchez, Pasadena, TX (US)

( * ) Notice: Subject to any disclaimer, the term of this patent is extended or adjusted under 35 U.S.C. 154(b) by 9 days.

(21) Appl. No.: 16/674,281

(22) Filed: Nov. 5, 2019

(65) Prior Publication Data

US 2020/0080340 A1 Mar. 12, 2020

Related U.S. Application Data

(63) Continuation-in-part of application No. 14/790,267, filed on Jul. 2, 2015, now abandoned, which is a continuation-in-part of application No. 13/239,157, filed on Sep. 21, 2011.

(60) Provisional application No. 61/385,619, filed on Sep. 23, 2010.

(51) Int. Cl.

| | |
|---|---|
| ***E04H 17/26*** | (2006.01) |
| ***B25B 27/02*** | (2006.01) |
| ***B25B 27/04*** | (2006.01) |
| ***B66F 19/00*** | (2006.01) |

(52) U.S. Cl.

CPC ..... *E04H 17/265* (2013.01); *B25B 27/02* (2013.01); *B25B 27/04* (2013.01); *B66F 19/005* (2013.01)

(58) Field of Classification Search

CPC ..... B66C 1/62; B66F 15/00; B66F 19/005; B25B 27/02; B25B 27/04; E04H 17/265

See application file for complete search history.

(56) References Cited

U.S. PATENT DOCUMENTS

| | | | | |
|---|---|---|---|---|
| 2,532,533 A * | 12/1950 | Baldwin | B66F 15/00 | 254/31 |
| 5,186,437 A * | 2/1993 | Scott | B66F 15/00 | 254/132 |
| 5,464,192 A * | 11/1995 | Burnham | E04H 17/265 | 254/30 |
| 6,367,779 B1 * | 4/2002 | Martin | E04H 17/265 | 254/243 |

* cited by examiner

*Primary Examiner* — Lee D Wilson
*Assistant Examiner* — Seahee Hong
(74) *Attorney, Agent, or Firm* — Bruce A. Lev

(57) ABSTRACT

A chain and lever post puller system for pulling 2 inch by 4 inch stakes from the ground. The apparatus may also pull round posts or tee-posts with a minimum of effort and with no prior digging. The chain and lever post puller system is a first class lever, requires no heavy equipment or hydraulics, and is easily transportable by hand. The puller comprises a vertical column to which the pivot lever is removably connected via a hinge, which also forms the fulcrum for the pivot lever. A first end of a chain is attached opposite the handle to the end of the pivot lever, and a self-tightening post grip is attached to the second end of the chain. A downward force is applied to the proximate end of the pivot lever when the post grip is attached to a stake to remove the stake via mechanical advantage.

15 Claims, 9 Drawing Sheets

CHAIN AND LEVER POST PULLER SYSTEMS

CROSS-REFERENCE TO RELATED APPLICATION

The present application is a Continuation-in-Part (CIP) related to and claims priority from prior provisional application Ser. No. 61/385,619 filed on Sep. 23, 2010, non-provisional application Ser. No. 13/239,157 filed Sep. 21, 2011, and non-provisional application Ser. No. 14/790,267 filed Jul. 2, 2015, which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of post pullers and more specifically relates to a chain and lever post puller system.

2. Description of the Related Art

The practice of driving posts into the ground to act as a support for various objects and purposes has long been used by individuals. Posts are sometimes cemented into the ground for stability but most often are simply hard-driven by post pounders such as when constructing range fencing. Highway crews may drive posts into the ground adjacent the highway to support traffic signs, and residential fences may be wire fences with posts driven into the ground to support it. Posts and stakes are driven into the ground for a multitude of purposes: residential fencing; city signage; highway signs; park signs and fencing; construction, etc.

Often, the need for the post that has been driven into the ground changes over time but removal is not always cost effective and often the post will either be left 'standing' or cut off at ground level; both potentially causing dangerous situations. Alternately, various methods may be used to pull posts that need to be removed due to the post's interference with construction projects, the eventuality of an injury, or the incompatibility with local environmental ordinances. These methods employed are often dangerous and require the use of a piece of powered equipment designed for a different purpose. When powered equipment, such as a backhoe is used to remove posts, two people are often needed. The ground person usually has to attach a chain and keep the tension while the backhoe moves away to eliminate the chain slack. Many injuries are reported in relation to these tasks. Powered equipment for removing posts can be vehicle mounted and operate hydraulically or utilize some other type of torque multiplying apparatus but generally are very large, heavy, and require a significant investment.

Alternative methods that may be used may be digging down by hand far enough to loosen the post and then pulling out the post by hand, which also can be expensive since it is time-consuming and labor intensive. A solution is needed that is inexpensive, easy and convenient to set up, does not require powered vehicles or equipment, and needs very little storage space when not in use.

Various attempts have been made to solve the above-mentioned problems such as those found in U.S. Pat. Nos. And Pub. Nos. 5,054,744; 4,235,034; 5,794,918; 3,576,311; 2,854,213; and 2006/0231810. This prior art is representative of post pullers. None of the above inventions and patents, taken either singly or in combination, is seen to describe the invention as claimed.

Ideally, a post puller should be convenient in-use and portable, and yet, would operate reliably and be manufactured at a modest expense. Thus, a need exists for a reliable chain and lever post puller system to easily and conveniently pull embedded posts from out of the ground, and to avoid the above-mentioned problems.

BRIEF SUMMARY OF THE INVENTION

In view of the foregoing disadvantages inherent in the known post puller art, the present invention provides a novel (fulcrum) chain and lever post puller system. The general purpose of the present invention, which will be described subsequently in greater detail, is to provide ease and convenience of use and portability.

A chain and lever post puller system is disclosed herein preferably comprising a vertical column having a top end and a bottom end and a bottom portion pivot hinge, a pivot lever comprising a proximate end and a distal end, a top portion pivot hinge, and a T-handle, a chain connector comprising a first end and a second end, and a post grip. The bottom portion pivot hinge is non-removably attached to the top end of the vertical column in preferred embodiments. The vertical column may comprise a reinforcement structure for supporting the downward force on the top portion pivot hinge and the bottom portion pivot hinge to provide durability in-use. The vertical column comprises about 24 inches in height with the bottom portion pivot hinge non-removably attached and the bottom side of the pivot lever near the distal end comprises the top portion pivot hinge which is non-removably attached. The pivot lever may be about 6 feet in length for high leverage, and hingedly and removably couples via the top portion pivot hinge and the bottom portion pivot hinge using a pin slidably inserted through the hinge orifices. The hinge forms a fulcrum point for the pivot lever and the proximate end of the pivot lever comprises a T-handle for applying downward force. The pivot lever is substantially straight but forms about an upward 20 degree angle near the proximate end with the T-handle non-removably and perpendicularly attached at the end of the angle portion. The upward angled portion allows for extending the reach of the downward stroke which lengthens the distance that the post or stake is pulled upward and out of the ground in each downward stroke. The first end of the chain connector may be removably attached to the second end of the pivot lever and the post grip is removably attached to the second end of the chain connector. The post grip may comprise a self-tightening cam gripper but in some embodiments may comprise a clamp tightened on the stake or post using fasteners.

The chain and lever post puller system is usable to remove a post from hard packed ground when the post grip is removably attached to a post and a downward force is exerted (applied) on the proximate end of the pivot lever. The chain and lever post puller in essence comprises a jack. The vertical column may further comprise a foot-plate which is perpendicularly oriented to the bottom end of the vertical column and is non-removably attached so as to prevent the vertical column from depressing below ground surface level when in use. The foot-plate is about 4 inches wide by about 4 inches long, but may be larger or smaller in some embodiments as per application. The foot-plate, the vertical column, and the pivot lever may comprise a ferrous metal and the vertical column and the pivot lever may be constructed of square tubing, but in some embodiments may be constructed of cylindrical pipe or other suitable equivalent. The post grip is able to removably grip a partially buried wooden (or other such as metal) 2 inch length by 4 inch width stake (or other size/profile post) for extracting from hard packed soil. The chain connector preferably comprises reinforced ferrous metal links but in other embodiments may use a wire rope with swaged eyelets attached to each end.

The present invention holds significant improvements and serves as a fulcrumed chain and lever post puller system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, chain and lever post puller system constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a post pulling device and more particularly to a chain and lever post puller system as used to improve the speed and convenience of pulling posts from the ground.

Figure 1:
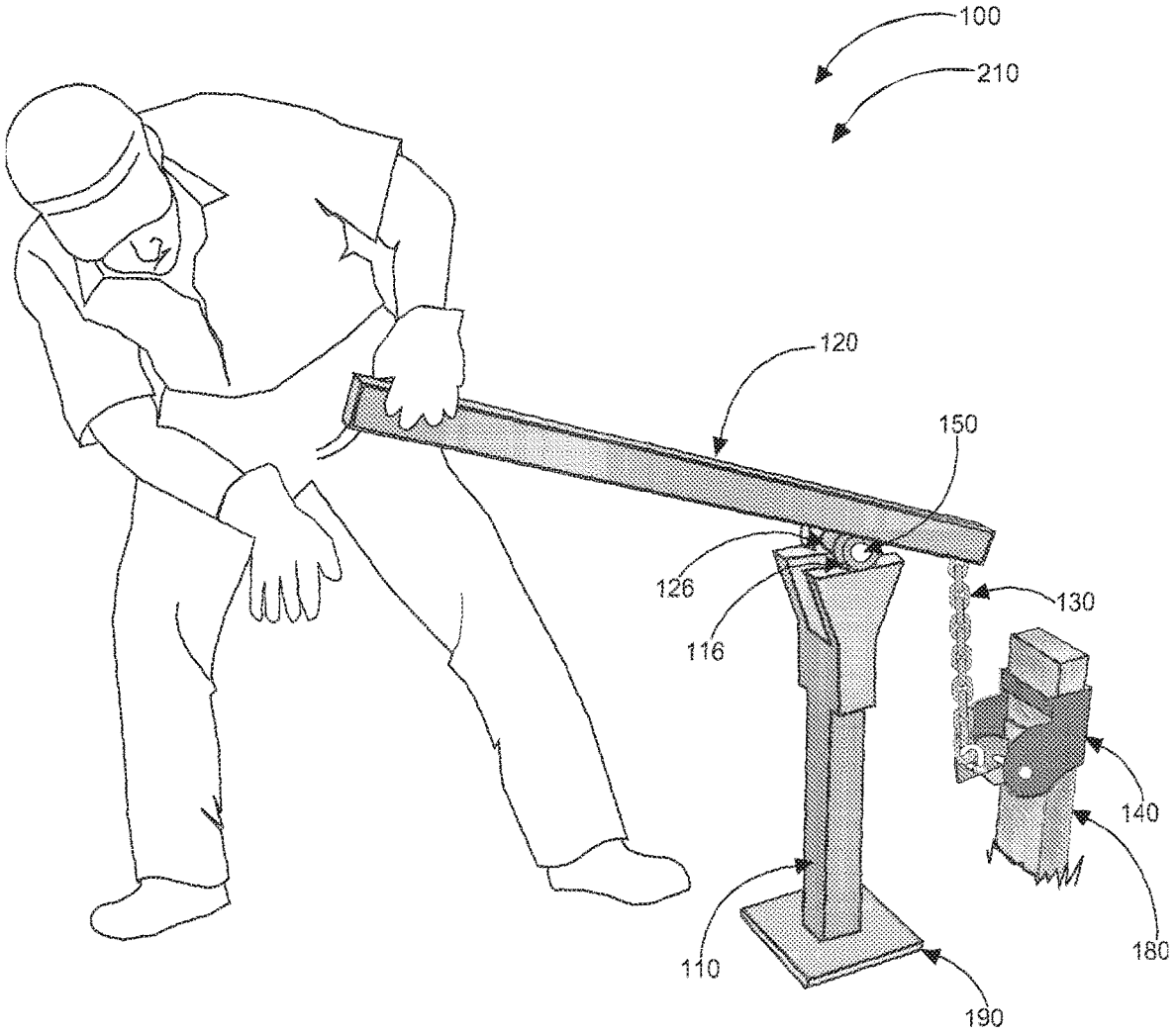
FIG. 1 shows a perspective view illustrating an in-use condition of a chain and lever post puller system according to an embodiment of the present invention.

Referring to the drawings by numerals of reference there is shown in FIG. 1, a perspective view illustrating an in-use condition 210 of chain and lever post puller system 100 according to an embodiment of the present invention.

Chain and lever post puller system 100 is a first class lever (in preferred embodiments) preferably comprising vertical column 110 having top end 112 and bottom end 114 and bottom portion pivot hinge 116, pivot lever 120 having proximate end 122 and distal end 124 and top portion pivot hinge 126 (as an assembly). The present invention also preferably comprises chain connector 130 having first end 132 and second end 134, and post grip(per) 140. Bottom portion pivot hinge 116 is preferably non-removably attached to the top end 112 of vertical column 110 and top portion pivot hinge 126 is non-removably attached to a bottom side of pivot lever 120 near distal end 124, creating at least one first class lever fulcrum means.

Vertical column 110 hingedly and removably mates with pivot lever 120 via bottom portion pivot hinge 116 and top portion pivot hinge 126 and is removably coupled via pin 150 (or other suitable fastener.) Bottom portion pivot hinge 116 and top portion pivot hinge 126 form fulcrum point 160 for pivot lever 120; pivot lever 120 provides a mechanical advantage. First end 132 of chain connector 130 is removably attached to distal end 124 of pivot lever 120 and post grip 140 is removably attached to second end 134 of chain connector 130. Chain and lever post puller system 100 is usable to remove post 180 from a hard packed ground when post grip 140 is removably attached to post 180 and a downward force is exerted on proximate end 122 of pivot lever 120. Post grip 140 is able to removably grip a partially buried metal post for pulling from hard packed soil using the mechanical advantage provided.

Figure 2:
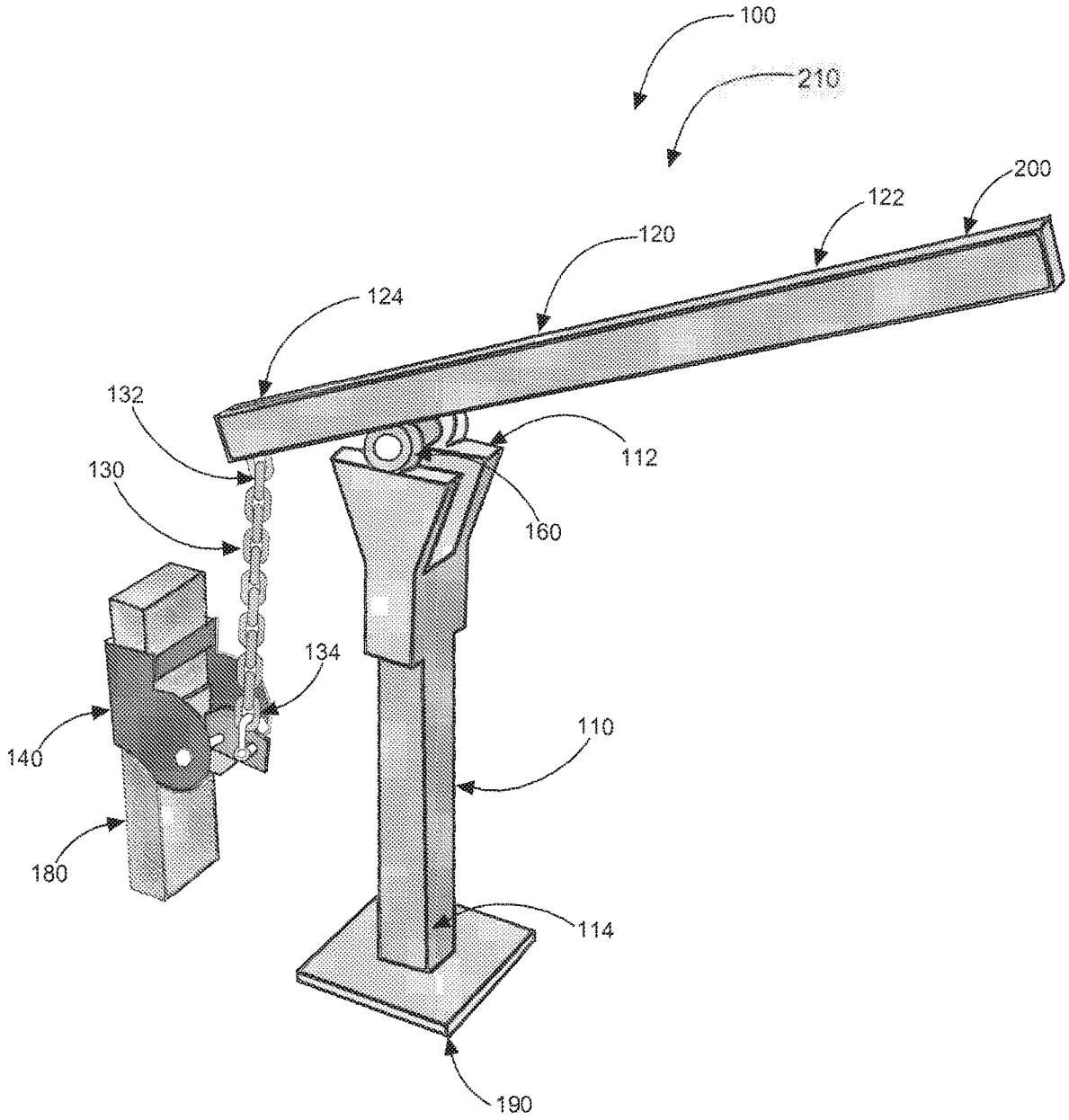
FIG. 2 is another perspective view illustrating the chain and lever post puller system according to an embodiment of the present invention of FIG. 1.

Referring now to FIG. 2, a perspective view illustrating chain and lever post puller system 100 according to an embodiment of the present invention of FIG. 1. Vertical column 110 further comprises foot-plate 190 (also shown in FIGS. 1, 3 and 4) which is preferably perpendicularly oriented to bottom end 114 of vertical column 110 and is non-removably attached thereto and useable to prevent vertical column 110 from depressing below a ground surface (level) when in use. Foot-plate 190 may comprise other angled relationships with vertical column 110 if needed for example if working on inclined surfaces. Foot-plate 190 is about 4 inches wide by about 4 inches long in this particular embodiment and preferably comprises a ferrous metal but in some embodiments may comprise a light-weight non-ferrous metal. Vertical column 110 and pivot lever 120 may comprise a ferrous metal for durability in use, but in alternate embodiments may also comprise a non-ferrous metal for ease of handling (light-weight.) Vertical column 110 and pivot lever 120 preferably comprise square tubing but in other embodiments may comprise cylindrical pipe.

Figure 3:
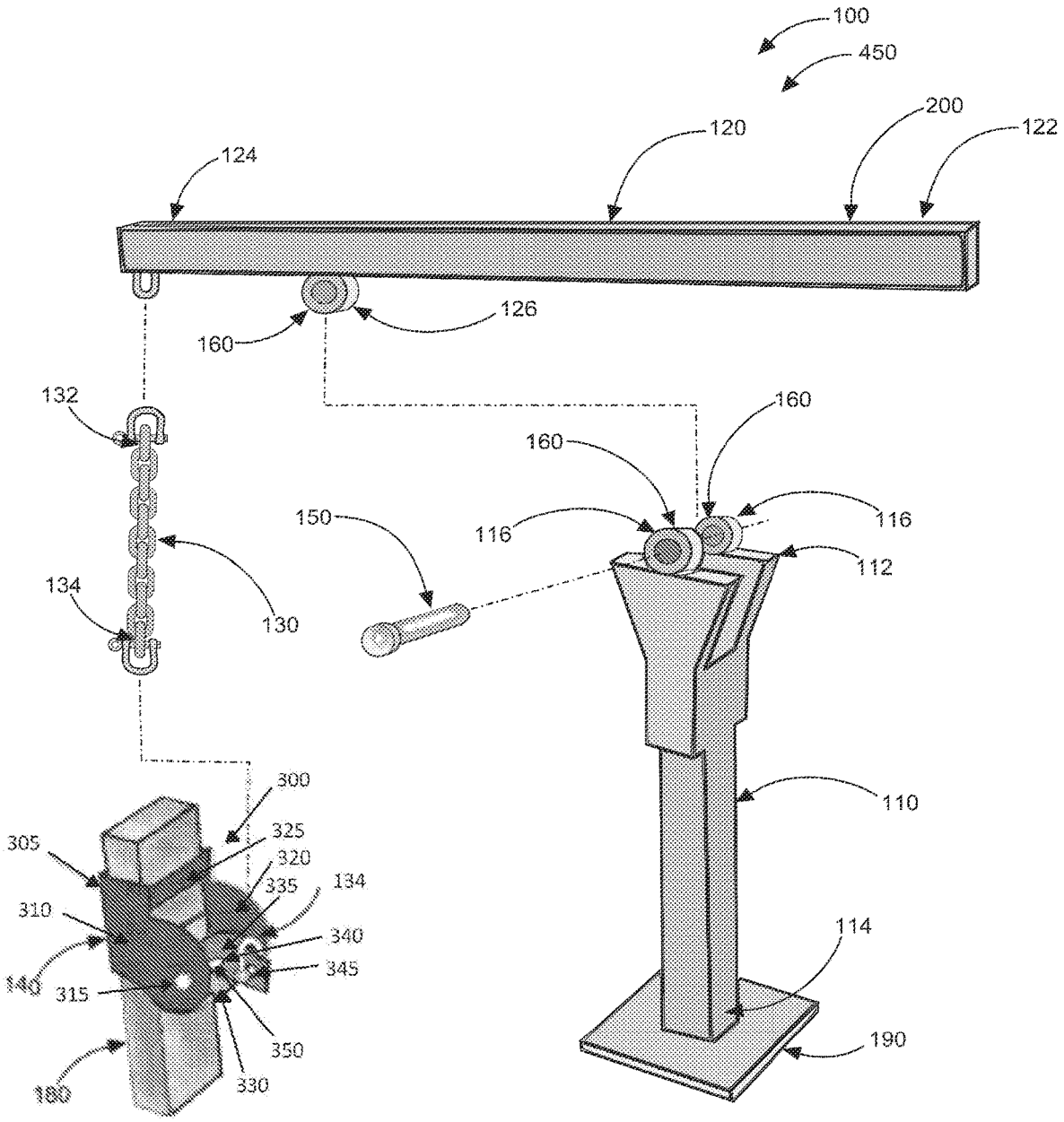
FIG. 3 is an exploded view illustrating separate components (as an assembly) of the chain and lever post puller system according to an embodiment of the present invention of FIGS. 1 and 2.

Referring now to FIG. 3, an exploded view illustrating the separate components of chain and lever post puller system 100 (as an assembly) according to an embodiment of the present invention of FIG. 1.

Chain connector 130 preferably comprises reinforced ferrous metal links but in some embodiments may comprise wire rope with swagged eyelets at the ends or other suitable equivalent connecting means. Post grip 140 may comprise a self-tightening cam gripper or may comprise a clamp fastened by bolts or by a biasing spring assisted cam fastener. Those with ordinary skill in the art will now appreciate that upon reading this specification and by their understanding the art of self-tightening cam grippers as described herein, methods of use will be understood by those knowledgeable in such art. Proximate end 122 of pivot lever 120 comprises handle 200 which may be square tubing or may comprise a cylindrical shape. A majority of the length of pivot lever 120 may comprise proximate end 122, which comprises from fulcrum point 160 to handle 200 end, and a minority of the length of pivot lever 120 may be at distal end 124 which is from fulcrum point 160 to end of distal end 124. In this way the present invention provides a mechanical advantage as a fulcrum (a first class lever system).

Figure 4:
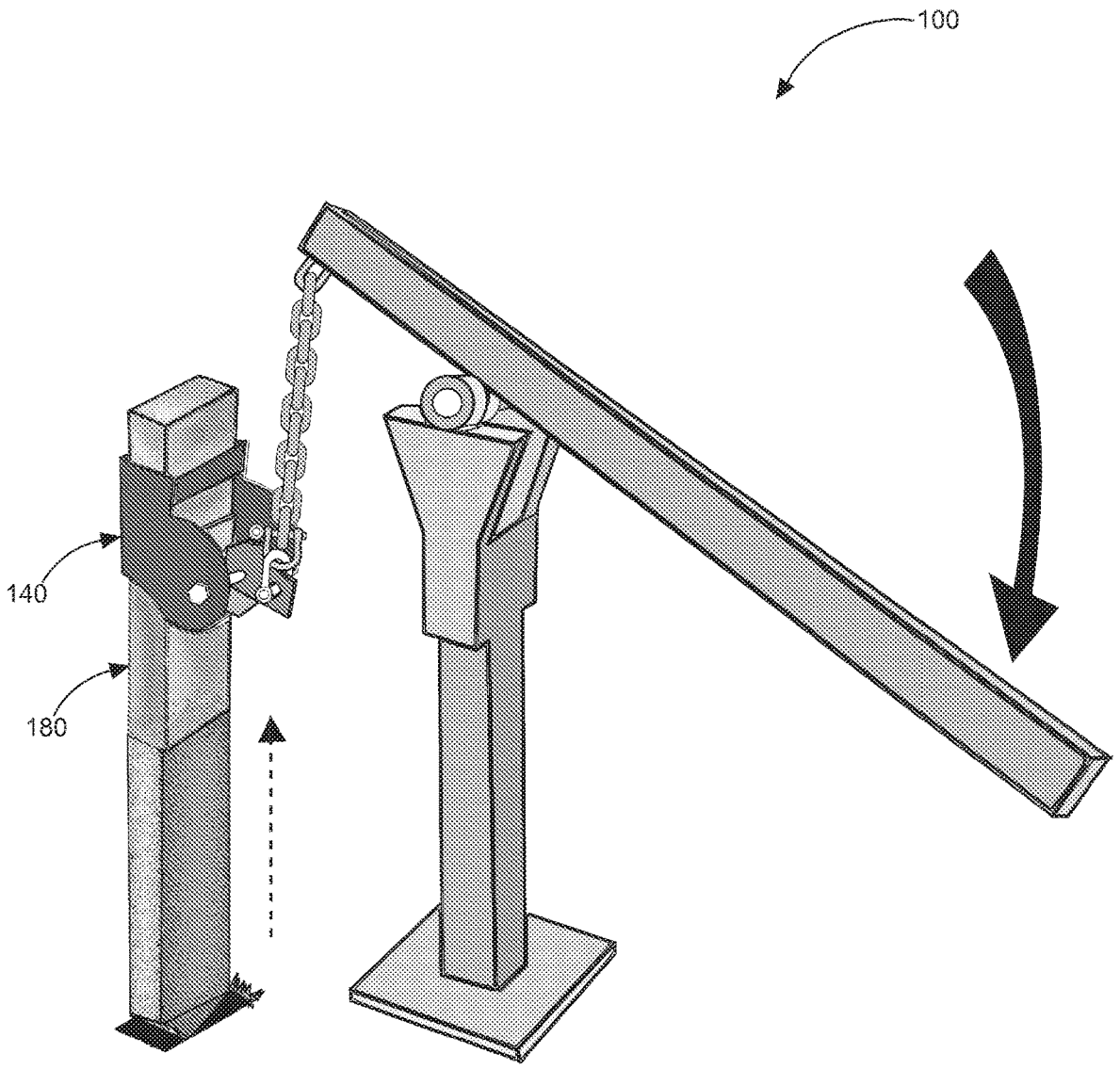
FIG. 4 is a perspective view illustrating the chain and lever post puller system (indicating the fulcruming means) according to an embodiment of the present invention of FIGS. 1 and 2.

Referring now to FIG. 4, a perspective view (as shown in FIG. 2) illustrating chain and lever post puller system 100 according to an embodiment of the present invention of FIGS. 1 and 2.

Post grip 140 is able to removably grip a partially buried wooden 2 inch length by 4 inch width stake for extracting from hard packed soil (movement as indicated by direction arrow.) Vertical column 110 comprises about 24 inches in height and pivot lever 120 preferably comprises about 6 feet in length providing sufficient mechanical advantage. Chain and lever post puller system 100 in essence comprises a 'jack' for applying multiplied lifting force on post 180 at the point of connection of post grip 140. Using the present invention downward rotational force about pin 150 is translated to upward pulling force parallel to vertical column 110 and substantially perpendicularly to the ground surface (and foot-plate 190.)

Chain and lever post puller system 100 according to an embodiment of the present invention of FIGS. 1-4, may be sold as kit 450 comprising the following parts: at least one vertical column 110; at least one pivot lever 120; top portion pivot hinge 126; at least one chain connector 130; at least one post grip 140 (other profiles may be included for cylindrical posts); and at least one set of user instructions. Chain and lever post puller system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, parts may be sold separately, etc., may be sufficient. Additionally, other materials of construction and arrangements such as the use of various metals or alloy(ed) combinations, variations on exact shape, or for example the substitution of wire rope for chain, may be sufficient.

Figure 5:
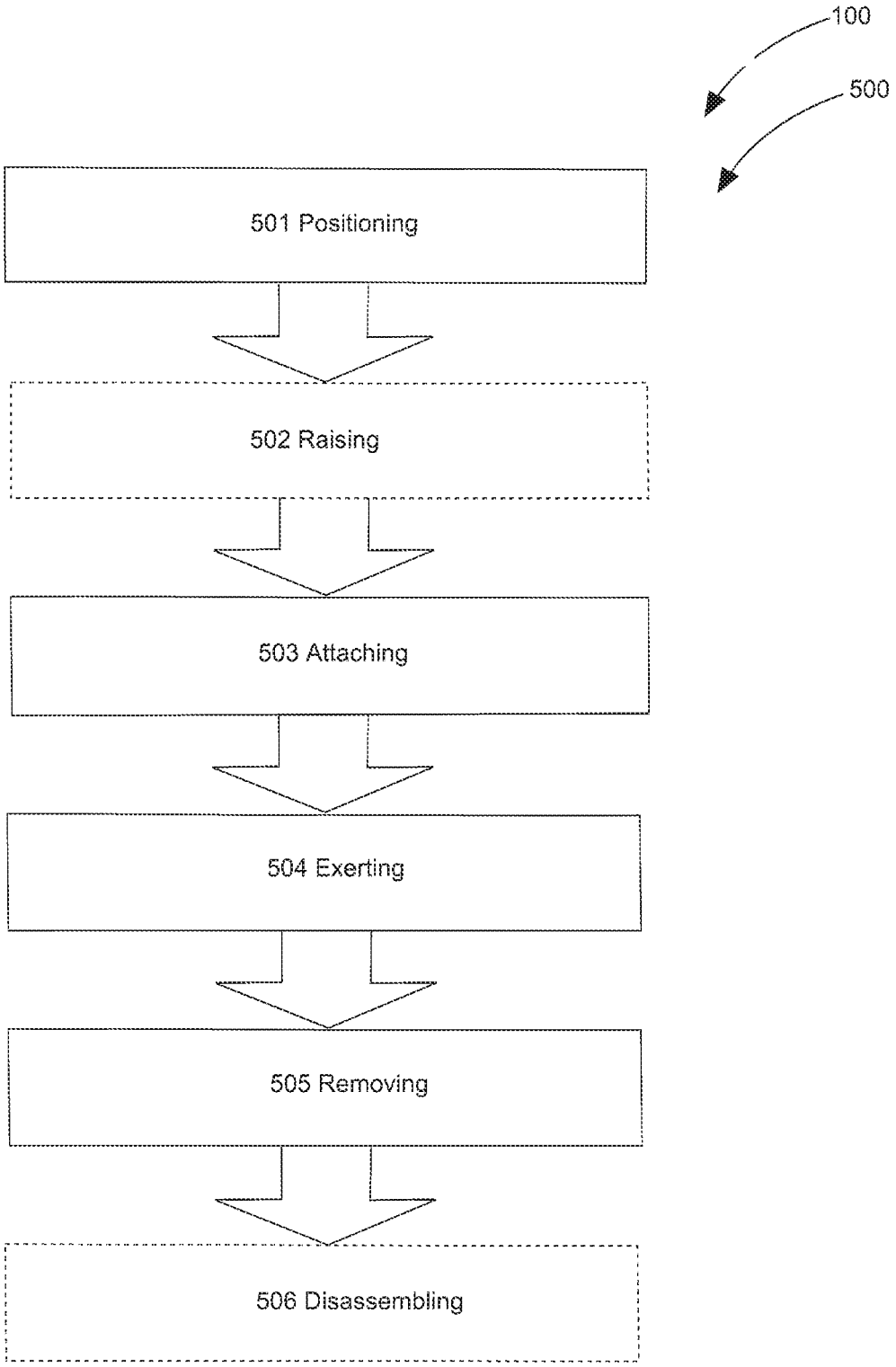
FIG. 5 is a flowchart illustrating a method of use for the chain and lever post puller system according to an embodiment of the present invention of FIGS. 1-4.

Referring now to FIG. 5, a flowchart illustrating method of use 500 of chain and lever post puller system 100 according to an embodiment of the present invention of FIGS. 1-4.

A method of using chain and lever post puller system 100 may comprise the steps of: step one 501 positioning chain and lever post puller system 100 next (adjacent) to post 180 to be removed; step two 502 raising proximate end 122 of pivot lever 120 to a 'high' (heightened) position; step three 503 attaching post grip 140 to post 180 (and connecting chain connector 130 to post grip 140); step four 504 exerting a downward force on proximate end 122 of pivot lever 120 to remove post 180; step five 505 removing post grip 140 and chain and lever post puller system 100. Method of using (embodying method of use 500) chain and lever post puller system 100 may further optionally comprise the step of: step six 506 disassembling chain and lever post puller system 100 for compact storage and/or transport.

It should be noted that step 506 is an optional step and may not be implemented in all cases. Optional steps of method 500 are illustrated using dotted lines in FIG. 5 so as to distinguish them from the other steps of method 500.

Figure 6:
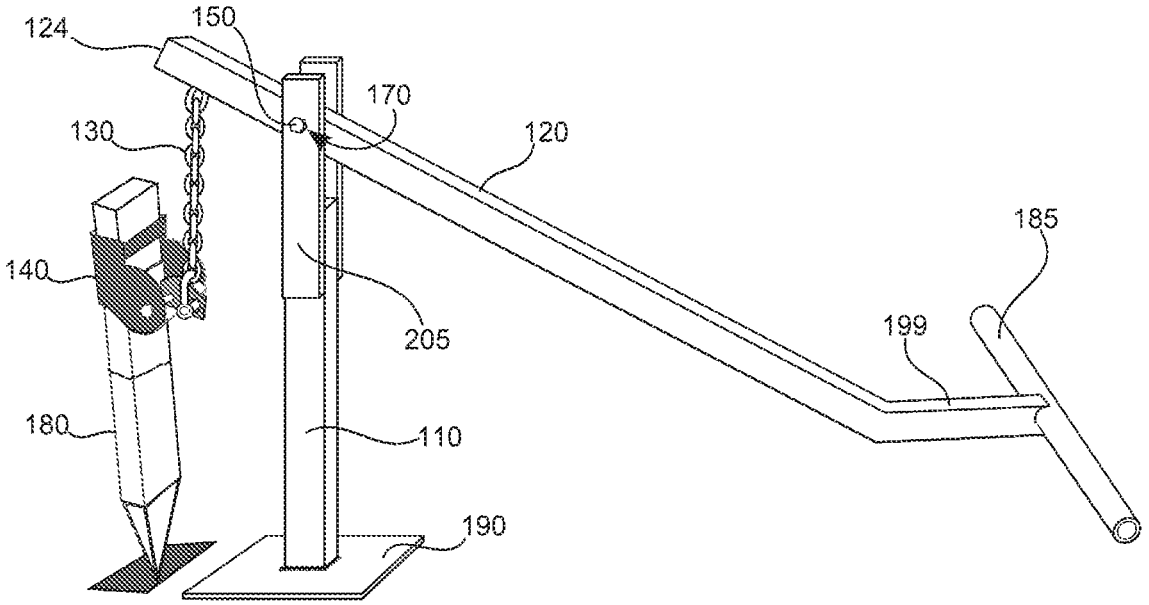
FIG. 6 is a perspective view illustrating a preferred embodiment of the chain and lever post puller system according to an embodiment of the present invention of FIGS. 1-5.

FIG. 6 is a perspective view illustrating a preferred embodiment of the chain and lever post puller system according to an embodiment of the present invention of FIGS. 1-5.

Pivot lever 120 may be about 6 feet in length for providing a high amount leverage but may be shorter or longer in other embodiments. Pivot lever 120 hingedly and removably couples to vertical column 110 via top portion pivot hinge 126 and bottom portion pivot hinge 116 using pin 150 slidably inserted through hinge orifices 170. A proximate end of pivot lever 120 comprises t-handle 185 for applying downward force. Pivot lever 120 is substantially straight but forms about an upward 20 degree angle near proximate with t-handle 185 non-removably and perpendicularly attached at the end of upward angled portion 199. Upward angled portion 199 allows for extending the reach of the downward stroke which lengthens the distance that post 180 is pulled upward and out of the ground in each downward stroke. Top end 112 may be shaped as depicted in FIGS. 1-4, or may just have two rectangular plates 205 non-removably attached to each side of vertical column 110 with hinge orifices 170 through rectangular plates 205 forming bottom portion pivot hinge 116, and hinge orifices 170 with pin 150 positioned horizontally through distal end 124 of pivot lever 120 forming top portion pivot hinge 126.

Figure 7:
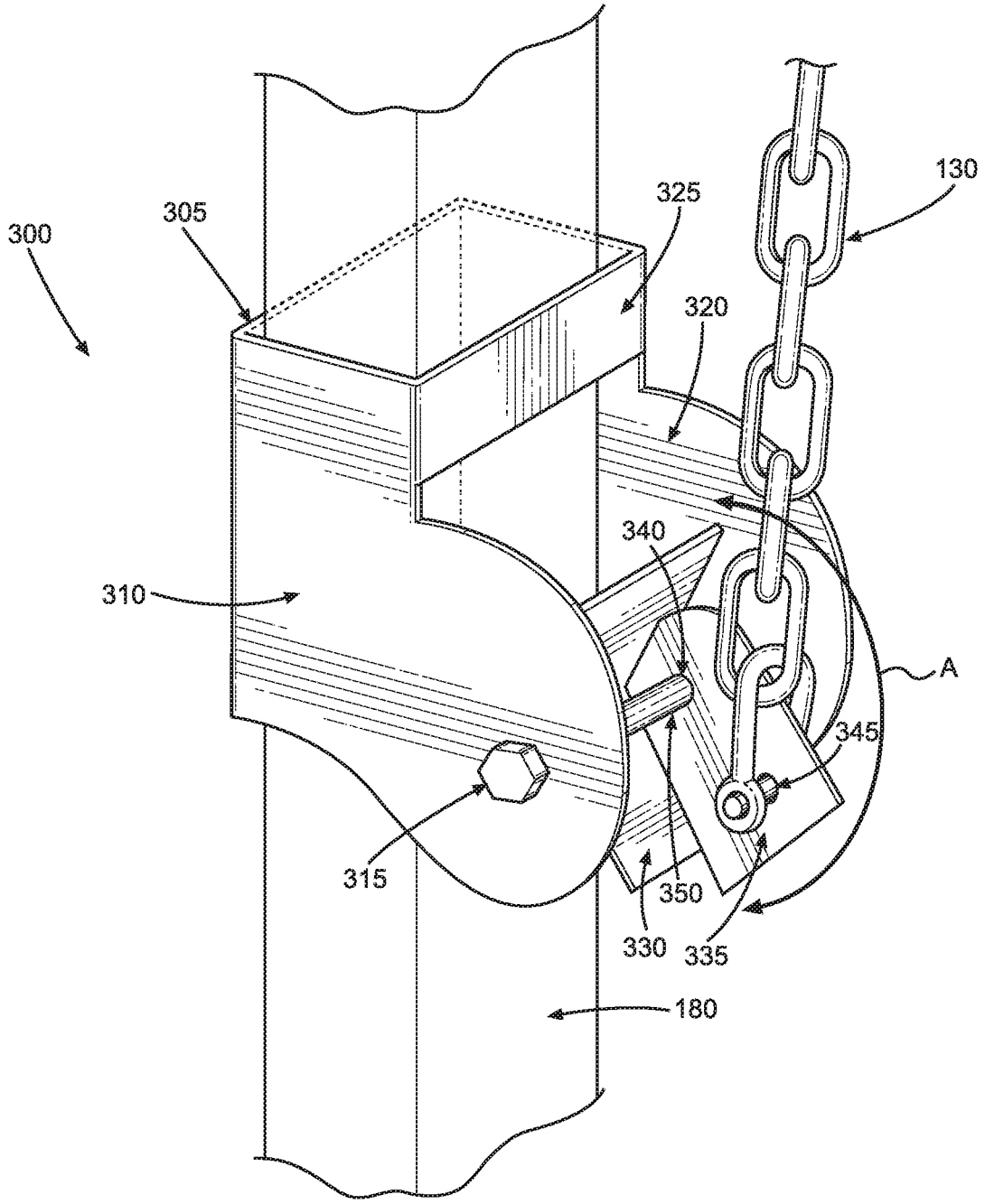
FIG. 7 is a perspective close-up view illustrating the post grip of the chain and lever post puller system according to an embodiment of the present invention of FIGS. 1-5 in a non-gripping position.
Figure 8:
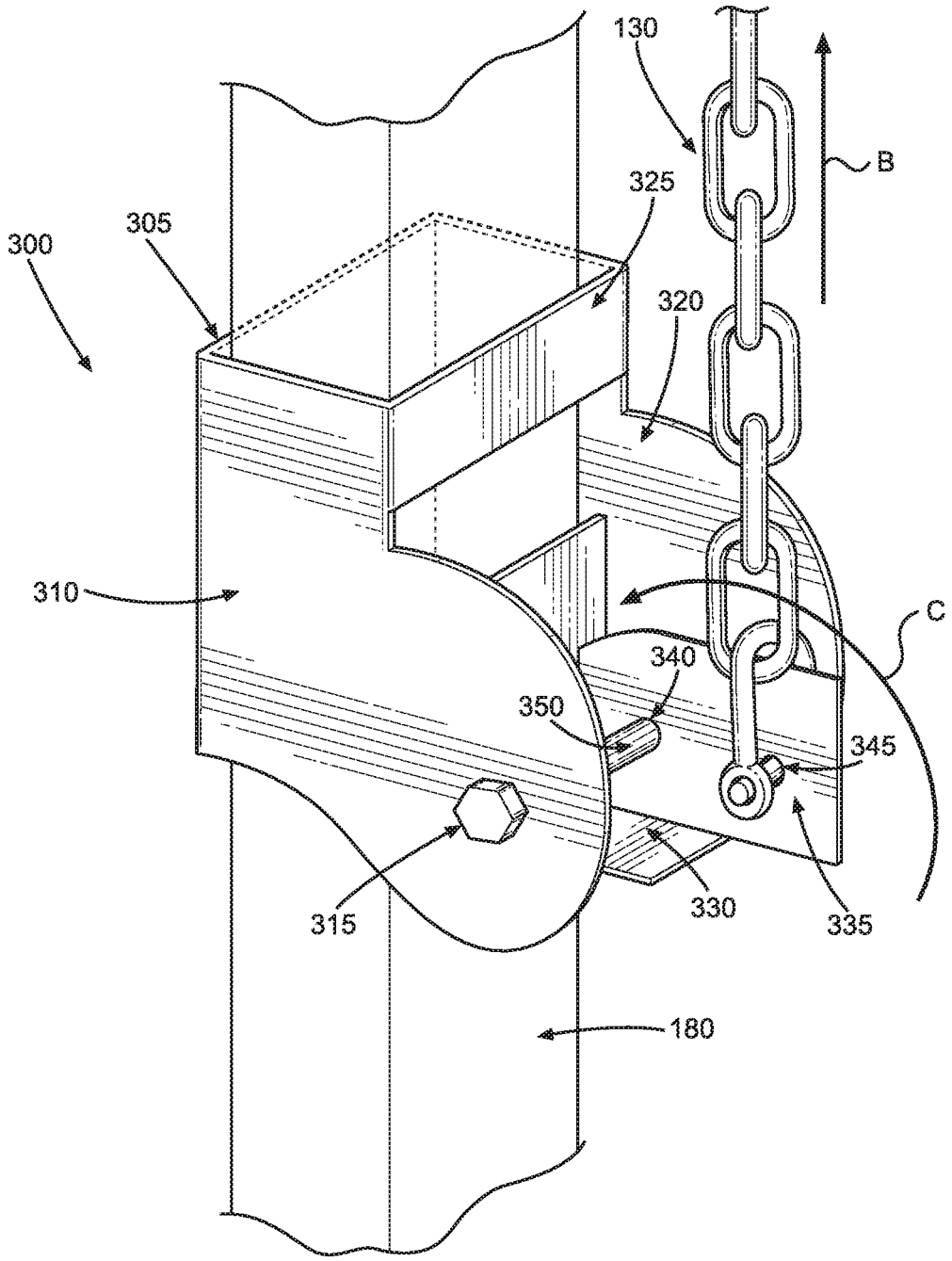
FIG. 8 is a perspective close-up view illustrating the post grip of the chain and lever post puller system according to an embodiment of the present invention of FIGS. 1-5 in a gripping position.

As further illustrated in FIGS. 3, 4, 7, and 8, the post grip 140 includes a cam gripper 300 comprising a back plate 305 including a first side portion; a second side portion spaced from the first side portion; a first side plate 310 including a pivot pin aperture 315 therethrough and connected to and extending substantially perpendicularly from the first side portion of the back plate 305; a second side plate 320 including a pivot pin aperture therethrough and connected to and extending substantially perpendicularly from the second side portion of the back plate 305; wherein the first side plate 310 and the second side plate 320 are positioned substantially parallel to one another; a cross-member 325 spaced from the back plate 305 and connected to and extending between the first side plate 310 and the second side plate 320, such that a substantially rectangular aperture is formed between the back plate 305, the first side plate 310, and the second side plate 320; an L-shaped bracket 330 having a width adapted to movably reside between the first side plate 310 and the second side plate 320; a pivot plate 335 including a pivot pin aperture 340 through a front portion thereof; and a connector aperture 345 through a back portion thereof, wherein said front portion is rigidly connected to the L-shaped bracket, such that the pivot plate extends substantially perpendicular to the L-shaped bracket, and wherein the pivot pin apertures of the pivot plate, the first side plate, and the second side plate are linearly aligned; and a pivot pin 350 extending through the pivot pin apertures of the pivot plate, the first side plate, and the second side plate, and is connected to the first side plate 310 and the second side plate 320, such that the L-shaped bracket 330 and the pivot plate 335 can pivot, as shown as pivoting motion "A" in FIG. 7, with respect to the back plate, the first side plate, and the second side plate; and wherein the second end of the chain connector is removably attached to the pivot plate via the connector aperture 345, such that when the chain connector 130 is pulled upwards by the pivot lever, as shown as pulling motion "B" in FIG. 8, the pivot plate 335 and the L-shaped bracket 330 pivot toward the back plate 305, as shown as pivoting motion "C" in FIG. 8, and is adapted to releasably apply pressure to and create friction between a post 180 and the post grip 140, such that the chain and lever post puller system can grip a post, including and more specifically a 2" by 4" (2×4) wooden piece of lumber, and pull it out of the ground.

Figure 9:
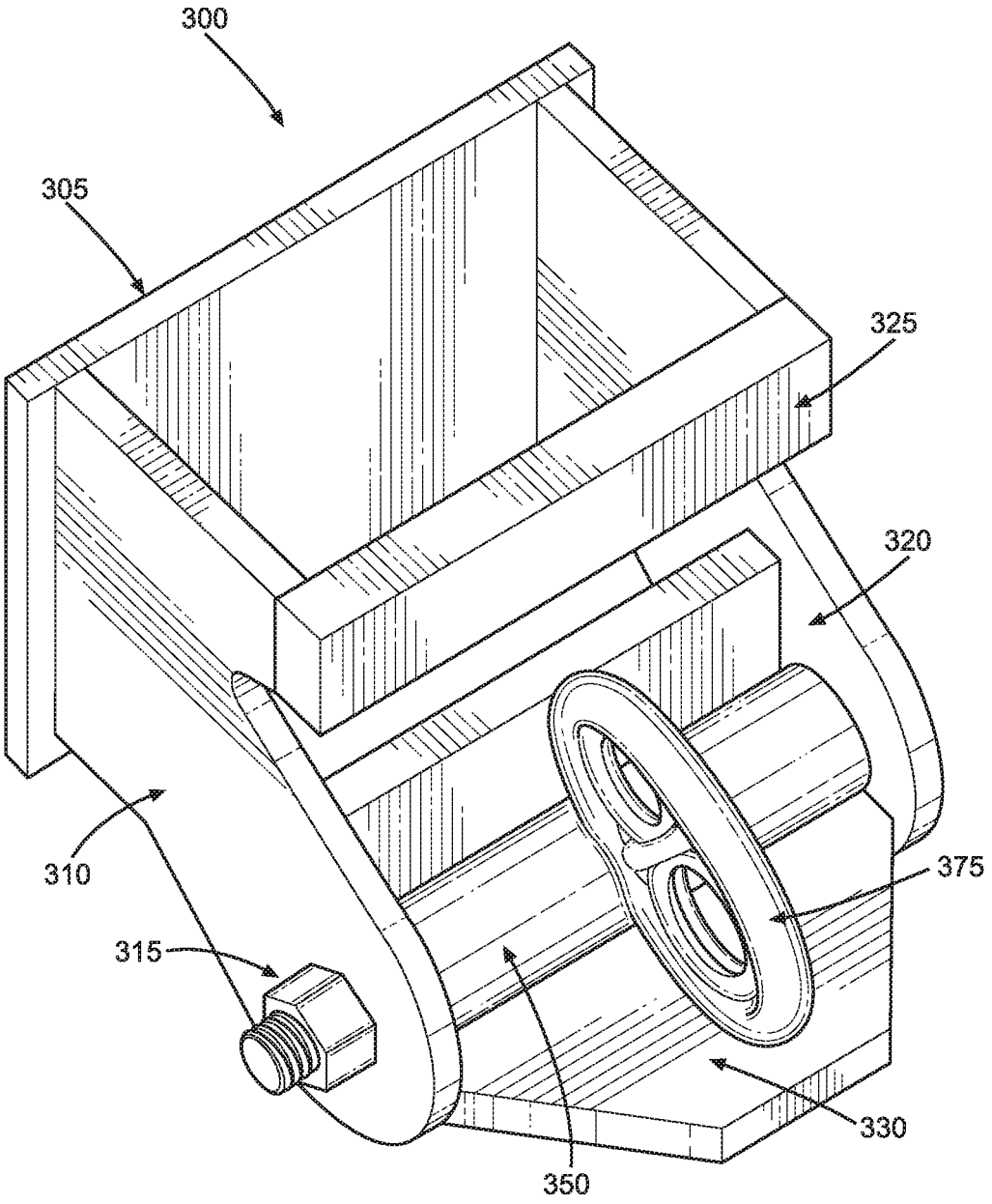
FIG. 9 is a perspective view illustrating an alternate embodiment of the post grip of the chain and lever post puller.

A further embodiment of the cam gripper 300 is illustrated in FIG. 9, wherein the back plate 305 is replaced with a double ring link 375 securely fastened to the L-shaped bracket 330 and adapted to releasably connect with chain connector 130.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A chain and lever post puller system comprising:

a vertical column comprising:

a top end and a bottom end, and a bottom portion pivot hinge;

a pivot lever comprising:

a proximate end and a distal end, a top portion pivot hinge;

a chain connector comprising:

a first end and a second end; and a post grip including:

a cam gripper comprising:

a back plate including:

a first side portion;

a second side portion spaced from said first side portion;

a first side plate including:

a pivot pin aperture therethrough;

wherein said first side plate is connected to and extends substantially perpendicularly from said first side portion of said back plate;

a second side plate including:

a pivot pin aperture therethrough;

wherein said second side plate is connected to and extends substantially perpendicularly from said second side portion of said back plate;

wherein said first side plate and said second side plate are positioned substantially parallel to one another;

a cross-member;

wherein said cross-member is spaced from said back plate and is connected to and extends between said first side plate and said second side plate, such that a substantially rectangular aperture is formed between said back plate, said first side plate, and said second side plate;

an L-shaped bracket;

wherein said L-shaped bracket has a width adapted to movably reside between said first side plate and said second side plate;

a pivot plate including:

a pivot pin aperture through a front portion thereof; and a connector aperture through a back portion thereof;

wherein said front portion is rigidly connected to said L-shaped bracket, such that said pivot plate extends substantially perpendicular to said L-shaped bracket, and wherein said pivot pin apertures of said pivot plate, said first side plate, and said second side plate are linearly aligned; and a pivot pin;

wherein said pivot pin extends through said pivot pin apertures of said pivot plate, said first side plate, and said second side plate, and is connected to said first side plate and said second side plate, such that said L-shaped bracket and said pivot plate can pivot with respect to said back plate, said first side plate, and said second side plate;

wherein said second end of said chain connector is removably attached to said pivot plate via said connector aperture, such that when said chain connector is pulled upwards by said pivot lever said pivot plate and said L-shaped bracket pivot toward said back plate and is adapted to releasably apply pressure to and create friction between a post and said post grip;

wherein said bottom portion pivot hinge is non-removably attached to said top end of said vertical column;

wherein said top portion pivot hinge is non-removably attached to a bottom side of said pivot lever in proximity to said distal end of said pivot lever;

wherein said vertical column hingedly and removably mates with said pivot lever via said bottom portion pivot hinge and said top portion pivot hinge such that said bottom portion pivot hinge and said top portion pivot hinge are coupled via a pin and form a fulcrum point for said pivot lever;

wherein said first end of said chain connector is removably attached to said distal end of said pivot lever; and wherein said chain and lever post puller system is adapted to remove the post from a ground material when said post grip is removably attached to said post and a downward force is exerted on said proximate end of said pivot lever.

2. The chain and lever post puller system of claim 1 wherein said vertical column further comprises a foot-plate and wherein said foot-plate is perpendicularly oriented to said bottom end of said vertical column and is non-removably attached thereto and is useable to prevent said vertical column from depressing below a ground material surface level when in use.

3. The chain and lever post puller system of claim 2 wherein said foot-plate is about 4 inches wide by about 4 inches long.

4. The chain and lever post puller system of claim 3 wherein said foot-plate is formed from a ferrous metal.

5. The chain and lever post puller system of claim 1 wherein said vertical column and said pivot lever are formed from a ferrous metal.

6. The chain and lever post puller system of claim 5 wherein said vertical column and said pivot lever are formed from square tubing.

7. The chain and lever post puller system of claim 5 wherein said vertical column and said pivot lever are formed from cylindrical pipe.

8. The chain and lever post puller system of claim 1 wherein said post grip is adapted to removably grip a partially buried wooden 2 inch length by 4 inch width stake for extracting from said ground material.

9. The chain and lever post puller system of claim 1 wherein said post grip is adapted to removably grip said partially buried metal post for pulling from said ground material.

10. The chain and lever post puller system of claim 1 wherein said chain connector is formed from ferrous metal links.

11. The chain and lever post puller system of claim 1 wherein said vertical column is formed having a dimension of 24 inches in height.

12. The chain and lever post puller system of claim 1 wherein said pivot lever is formed having a dimension of 6 feet in length.

13. The chain and lever post puller system of claim 1 wherein said proximate end of said pivot lever comprises a t-handle.

14. A chain and lever post puller system comprising:

a vertical column comprising:
- a top end and a bottom end, and
- a bottom portion pivot hinge;

a pivot lever comprising:
- a proximate end and a distal end, and
- a top portion pivot hinge;

a chain connector comprising,
- a first end and a second end;

a foot-plate;

a pin; and a post grip including:
- a cam gripper comprising:
  - a back plate including:
    - a first side portion;
    - a second side portion spaced from said first side portion;
  - a first side plate including:
    - a pivot pin aperture therethrough;
    - wherein said first side plate is connected to and extends substantially perpendicularly from said first side portion of said back plate;
  - a second side plate including:
    - a pivot pin aperture therethrough;
    - wherein said second side plate is connected to and extends substantially perpendicularly from said second side portion of said back plate;
  - wherein said first side plate and said second side plate are positioned substantially parallel to one another;
  - a cross-member;
    - wherein said cross-member is spaced from said back plate and is connected to and extends between said first side plate and said second side plate, such that a substantially rectangular aperture is formed between said back plate, said first side plate, and said second side plate;
  - an L-shaped bracket;
    - wherein said L-shaped bracket has a width adapted to movably reside between said first side plate and said second side plate;
  - a pivot plate including:
    - a pivot pin aperture through a front portion thereof; and
    - a connector aperture through a back portion thereof;
    - wherein said front portion is rigidly connected to said L-shaped bracket, such that said pivot plate extends substantially perpendicular to said L-shaped bracket, and
  - wherein said pivot pin apertures of said pivot plate, said first side plate, and said second side plate are linearly aligned; and
  - a pivot pin;
    - wherein said pivot pin extends through said pivot pin apertures of said pivot plate, said first side plate, and said second side plate, and is connected to said first side plate and said second side plate, such that said L-shaped bracket and said pivot plate can pivot with respect to said back plate, said first side plate, and said second side plate;

wherein said second end of said chain connector is removably attached to said pivot plate via said connector aperture, such that when said chain connector is pulled upwards by said pivot lever said pivot plate and said L-shaped bracket pivot toward said back plate and is adapted to releasably apply pressure to and create friction between a post and said post grip;

wherein said bottom portion pivot hinge is non-removably attached to said top end of said vertical column;

wherein said vertical column comprises about 24 inches in height;

wherein said top portion pivot hinge is non-removably attached to a bottom side of said pivot lever near said distal end of said pivot lever;

wherein said pivot lever comprises about 6 feet in length;

wherein said vertical column hingedly and removably mates with said pivot lever via said bottom portion pivot hinge and said top portion pivot hinge such that said bottom portion pivot hinge and said top portion pivot hinge are coupled via said pin and form a fulcrum point for said pivot lever;

wherein said proximate end of said pivot lever comprises a handle;

wherein said first end of said chain connector is removably attached to said distal end of said pivot lever;

wherein said chain and lever post puller system is usable to remove the post from a ground material when said post grip is removably attached to said post and a downward force is exerted on said proximate end of said pivot lever;

wherein said vertical column further comprises said foot-plate and wherein said foot-plate is substantially perpendicularly oriented to said bottom end of said vertical column and is non-removably attached thereto and useable to prevent said vertical column from depressing below a ground material surface level when in use;

wherein said foot-plate is about 4 inches wide by about 4 inches long;

wherein said foot-plate comprises a ferrous metal;

wherein said vertical column and said pivot lever comprise said ferrous metal;

wherein said vertical column and said pivot lever comprise square tubing or cylindrical pipe;

wherein said post grip is able to removably grip a partially buried wooden or metal 2 inch length by 4 inch width stake for extracting from said ground material;

wherein said chain connector comprises ferrous metal links; and wherein said chain and lever post puller system is adapted to remove said post from said ground material when said post grip is removably attached to said post and a downward force is exerted on said proximate end of said pivot lever.

15. The chain and lever post puller system of claim 14 further comprising a kit including:

at least one said vertical column;

said pivot lever;

at least one said chain connector;

at least one said post grip; and a set of user instructions.

* * * * *